US007537140B2

(12) United States Patent
Lin

(10) Patent No.: US 7,537,140 B2
(45) Date of Patent: May 26, 2009

(54) LIQUID SOAP DISPENSER

(76) Inventor: Yeng-Tang Lin, No. 116, Lane 402, Sec. 1, Yongsing Rd., Wuci Township, Taichung County 435 (TW)

( * ) Notice: Subject to any disclaimer, the term of this patent is extended or adjusted under 35 U.S.C. 154(b) by 631 days.

(21) Appl. No.: 11/326,466

(22) Filed: Jan. 6, 2006

(65) Prior Publication Data

US 2007/0158367 A1 Jul. 12, 2007

(51) Int. Cl.
*B65D 88/54* (2006.01)

(52) U.S. Cl. ..... 222/321.7; 222/181.1; 222/321.3; 222/341; 222/380; 222/383.1; 222/481.5

(58) Field of Classification Search ..... 222/321.7, 222/571, 321.1, 380, 383.1, 341, 321.3, 372, 222/185.1, 490, 181.1, 491, 494, 375, 481.5
See application file for complete search history.

(56) References Cited

U.S. PATENT DOCUMENTS 2,003,562 A * 6/1935 Stuart ..... 222/82
2,283,529 A * 5/1942 Bobrick ..... 222/321.3
2,529,365 A * 11/1950 Barksdale ..... 222/181.2
2,622,539 A * 12/1952 Martin ..... 417/549
2,709,025 A * 5/1955 Scott ..... 222/341
3,211,340 A * 10/1965 Zander ..... 222/95
3,952,918 A * 4/1976 Poitras et al. ..... 222/82
5,823,397 A * 10/1998 Gil ..... 222/181.3
6,016,936 A * 1/2000 Fan ..... 222/181.1

* cited by examiner

*Primary Examiner*—Frederick C. Nicolas

(57) ABSTRACT

A pump mechanism of liquid soap dispenser includes a cross pipe secured to a first check valve, a spout having a second check valve, and an abutment member respectively; a spring biased plunger partially inserted into the abutment member; and a cap on an end of the plunger. In response to depressing the cap the plunger slides to compress the spring, close the first check valve, and decrease a liquid storage space of the pipe for forcing pressurized soap to open the second check valve prior to flowing out of the spout. In response to removing the depressing force the spring pushes the plunger to its inoperative position to create a vacuum in the space, open the first check valve, permit soap supply to flow into the space through the first check valve, and close the second check valve at an end of returning the plunger to its inoperative position.

2 Claims, 6 Drawing Sheets

LIQUID SOAP DISPENSER

BACKGROUND OF THE INVENTION

1. Field of Invention

The present invention relates to dispensing devices and more particularly to an improved liquid soap dispenser.

2. Related Art

Liquid soap dispensers are generally classified as stand soap dispenser and wall mounted soap dispenser. A conventional stand type liquid soap dispenser is shown in FIGS. 1 and 2 and comprises a container (e.g., one made of plastics) 1 with supply of liquid soap contained therein, a hollow nut A is mounted on a top opening of the container 1, a hollow cylinder 11 having an upper portion mounted at the container opening by the nut A, a ring 13 mounted on top of the cylinder 11, a sliding spout tube 14 provided through the ring 13, the nut A, and the container opening to be fastened by a positioning member 131, a plunger 17 including a shaft 171 extended from its intermediate disk-shaped member downwardly into its internal space, an intermediate annular groove 172 formed on the disk-shaped member and being in fluid communication with an internal space of the cylinder 11, and an upper soap tube 173 having a top connected to a bottom of the cylinder 11, a spring S having an upper portion put on the shaft 171 and a lower portion biased against a bottom of the cylinder 11, a seal 18 slidably provided between the soap tube 173 and an inner surface of the cylinder 11, an inner tube 12 having a top end secured to an underside of the cylinder 11 and a lower end extended into the supply of soap, a pump handle 16 mounted on a top of the spout tube 14, and a spout 15 formed at an open end of the handle 16.

In an inoperative position, both the soap tube 173 and the groove 172 are closed by the seal 18. For dispensing soap, a user may depress the handle 16 and thus the spout tube 14 as indicated by arrow P. Also, the seal 18, the disk-shaped member of the plunger 17, and the spout tube 14 lower with the spring S being compressed in the cylinder 11 by the disk-shaped member of the plunger 17. But the downward moving distance of the seal 18 is smaller than that of the spout tube 14. Thus, a gap is formed between the seal 18 and the groove 172 (i.e., a vacuum is created). Then soap is drawn from the supply of soap to the soap tube 173 through the inner tube 12, the cylinder 11, and the groove 172. Finally, soap flows out of the spout 15 from the soap tube 173 through the spout tube 14.

However, the prior art suffered from a disadvantage. For example, amount of soap flowing out of the spout 15 may decrease as the remaining amount of the supply of soap decreases. That is, less soap is dispensed as pumping times increases. It is often that a user even cannot pump out any soap when the supply of soap is below half of its full capacity. This is because the created vacuum decreases as distance between a top of the spring S and liquid level increases (i.e., supply of soap gradually consumed). Thus, the need for improvement still exists.

SUMMARY OF THE INVENTION

It is therefore an object of the present invention to provide a device for dispensing liquid soap comprising a plastic container filled with supply of liquid soap and including a projecting bottom opening threadedly secured to a nut; and a pump mechanism including a first check valve provided in the opening of the container; a ring member put on the first check valve; a cross-shaped pipe including a top section secured to the first check valve, a projecting bottom section, and a transverse section; a spout secured to the bottom section; a second check valve provided in the spout; an abutment member provided into and secured to the transverse section; a sliding plunger partially inserted into the abutment member and including a forward hollow extension, a rear externally threaded portion, a sealing shoulder between the extension and the externally threaded portion, and an adjustment ring threadedly put on the externally threaded portion; a spring biased between a bottom of the extension and a closed end of the transverse section; and a cap provided on an outer end of the plunger; wherein in an inoperative position the second check valve is closed and the first check valve is open to permit the supply of liquid soap to flow into a space defined by the transverse section and the adjustment ring and store therein, in response to depressing the cap the plunger slides to compress the spring, close the first check valve, and decrease the space for forcing the pressurized liquid soap to flow into the bottom section to open the second check valve prior to flowing out of the spout, and in response to removing the depressing force the stored compression energy of the spring pushes the plunger to its inoperative position to create a vacuum in the space, open the first check valve, permit the supply of liquid soap to flow into the space through the first check valve, and close the second check valve at an end of returning the plunger to its inoperative position.

It is another object of the present invention to provide a device for dispensing liquid soap comprising a plastic container filled with supply of liquid soap and including a projecting bottom opening threadedly secured to a nut; and a pump mechanism including a first check valve provided in the opening of the container; a ring member put on the first check valve; a T-shaped pipe including a top section secured to the first check valve and a transverse section; an abutment member provided into and secured to the transverse section a sliding plunger partially inserted into the abutment member and including a forward hollow extension, a rear externally threaded portion, a sealing shoulder between the extension and the externally threaded portion, and an adjustment ring threadedly put on the externally threaded portion; a spout secured to the outer end of the plunger and being in fluid communication with the second check valve; a spring biased between a bottom of the extension and a closed end of the transverse section; a second check valve provided in the outer end of the plunger; and a cap provided on the outer end of the plunger; wherein in an inoperative position the second check valve is closed and the first check valve is open to permit the supply of liquid soap to flow into a space defined by the transverse section and the adjustment ring and store therein, in response to depressing the cap the plunger slides to compress the spring, close the first check valve, and decrease the space for forcing the pressurized liquid soap to open the second check valve prior to flowing out of the spout, and in response to removing the depressing force the stored compression energy of the spring pushes the plunger to its inoperative position to create a vacuum in the space, open the first check valve, permit the supply of liquid soap to flow into the space through the first check valve, and close the second check valve at an end of returning the plunger to its inoperative position.

In one aspect of the present invention the ring member is sealingly engaged with the first check valve in the inoperative position, and wherein the ring member is adapted to wrinkle permit air to enter the container through the opening in response to a decreased pressure within the container after a predetermined amount of the supply of liquid soap has been dispensed.

In another aspect of the present invention there is further provided an aesthetic enclosure around the pump mechanism.

The above and other objects, features and advantages of the present invention will become apparent from the following detailed description taken with the accompanying drawings.

DETAILED DESCRIPTION OF THE INVENTION

Figure 1:
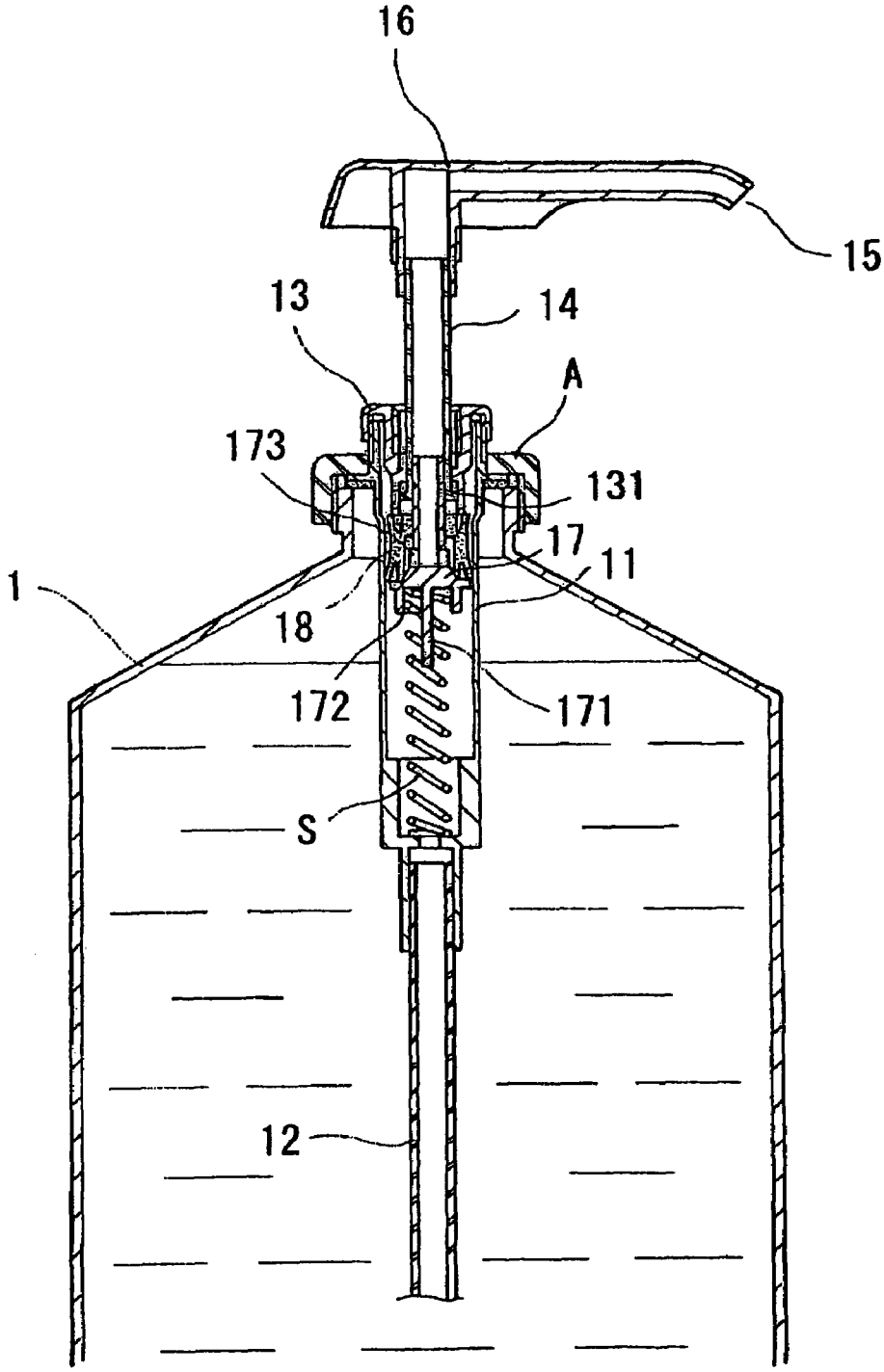
FIG. 1 (Prior Art)
FIG. 1 is a sectional view of a conventional liquid soap dispenser in its inoperative position.
Figure 2:
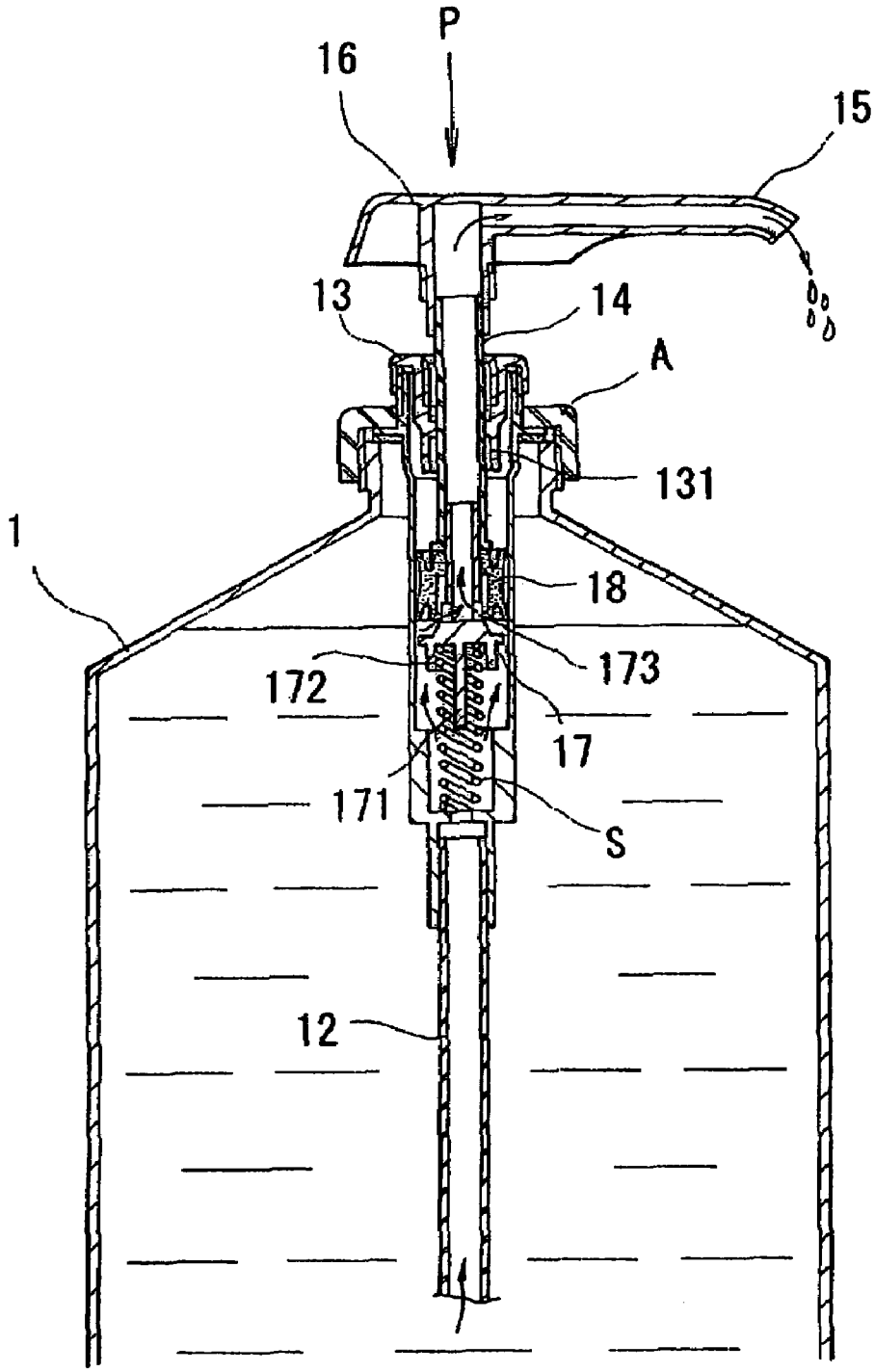
FIG. 2 (Prior Art)
FIG. 2 is a view similar to FIG. 1 where the soap dispenser is in its use position.
Figure 3:
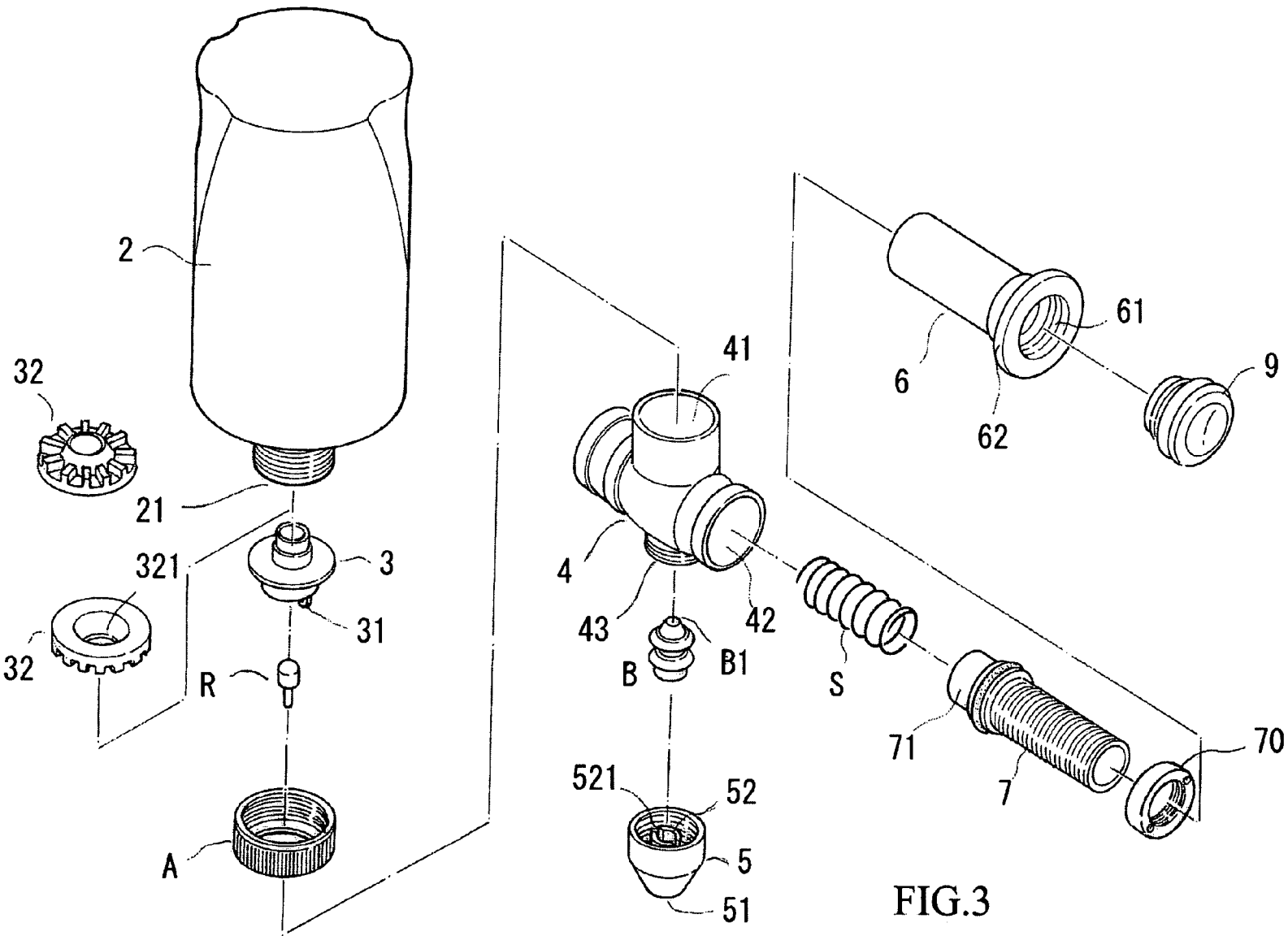
FIG. 3 is an exploded view of a first preferred embodiment of liquid soap dispenser according to the invention.
Figure 5:
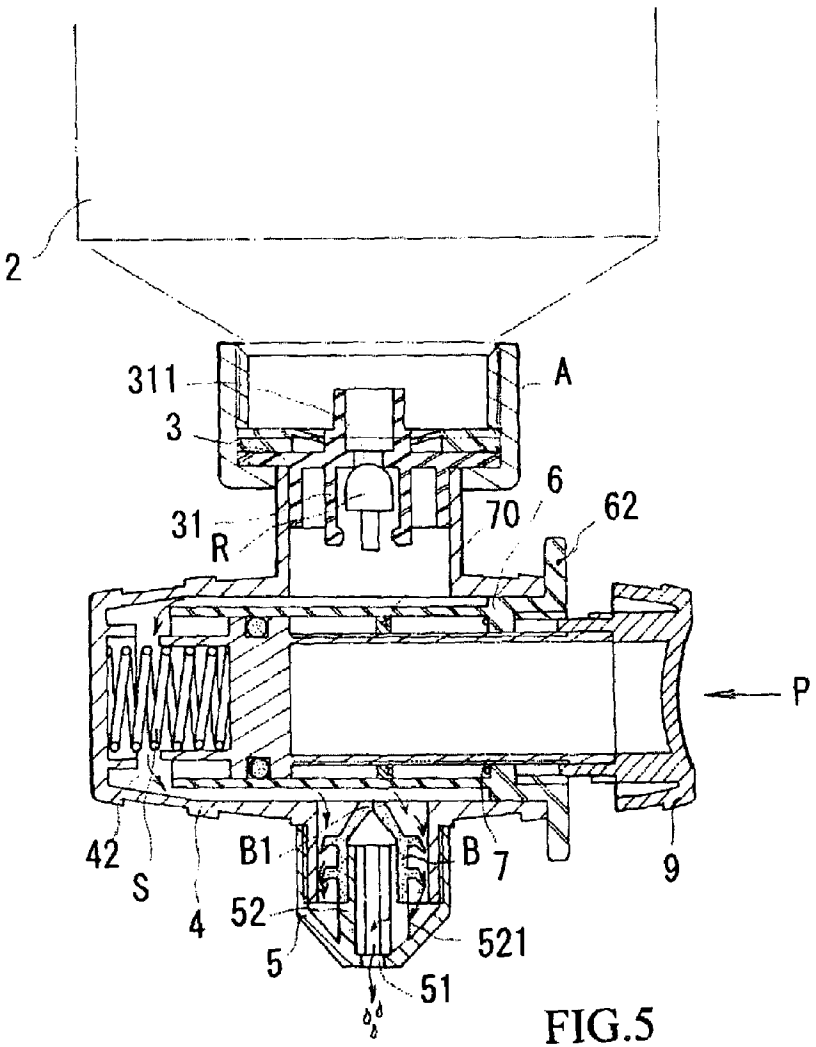
FIG. 5 is a view similar to FIG. 4 where the soap dispenser is in its use position.
Figure 4:
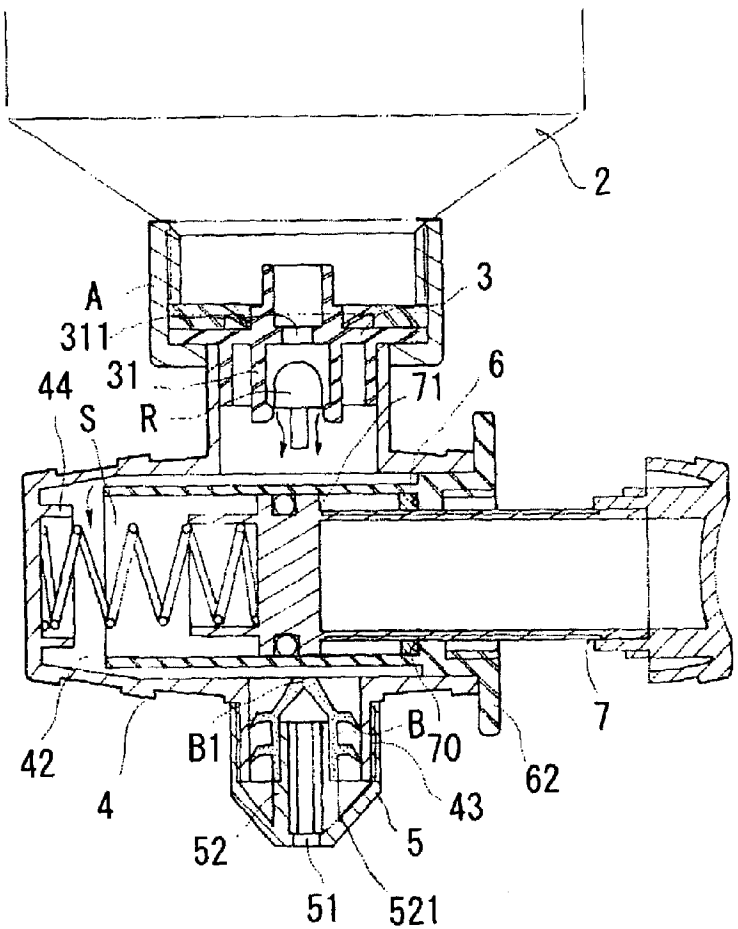
FIG. 4 is a sectional view of a pump mechanism of the assembled liquid soap dispenser of FIG. 3 in its inoperative position.

Referring to FIGS. 3 to 5, a liquid soap dispenser in accordance with a first preferred embodiment of the invention is shown. The liquid soap dispenser comprises a container (e.g., one made of plastics) 2 with supply of liquid soap contained therein and including a projecting bottom opening 21 having outer threads, a pad 3 including a hollow seat 31 projected from an underside with a valve R fitted therein, the seat 31 having a central opening 311, and a ring 32 put on a projecting top tube of the pad 3 and having a central hole 321, a cross-shaped pipe 4 including a top section 41 secured to the pad 3 by threadedly securing a nut A to the opening 21 with the pad 3 being fastened at the opening 21, a projecting bottom section 43 having outer threads, and a transverse section 42, a spout 5 threadedly secured to the bottom section 43 and including a bottom opening 51 and an internal tube 52 having a plurality of grooves 521 therearound, a check valve B fitted in the tube 52 and including a top conic opening B1, an abutment member 6 inserted into and secured to the transverse section 42 and including an enlargement 62 at an outer end for facilitating pushing the abutment member 6 into the transverse section 42 for fastening, and a central channel with inner threads 61 on an inner surface of the enlargement 62, a hollow plunger 7 partially inserted into the abutment member 6 and including a forward extension 71 and an adjustment ring 70 having inner threads threadedly put on a threaded outer surface of the plunger 7, the adjustment ring 70 being adapted to adjust amount of soap to be dispensed, a spring S having one end urged against a bottom of the extension 71 and the other end urged against a cylindrical receptacle 44 at a closed end of the transverse section 42 of the pipe 4, and a cap 9 fitted on an outer opening of the plunger 7. Note that the cap 8 has an externally threaded extension in its front end such that the cap 8 is adapted to secure to the threads 61 for securing to the abutment member 6 prior to assembling the liquid soap dispenser.

The ring 32 is sealingly engaged with the top of the pad 3 in an inoperative position of the liquid soap dispenser. A peripheral surface of the container 2 may recess after a predetermined amount of soap has been dispensed due to pressure imbalance between internal pressure of the container 2 and the atmospheric pressure as experienced in the prior art. Advantageously, the hole 321 of the ring 32 may wrinkle when pressure imbalance occurs in order to permit air to enter the container 2 through the opening 21. As such, pressure between internal pressure of the container 2 and the atmospheric pressure is balanced again. As a result, the container 2 is prevented from being recessed.

A pumping operation of the liquid soap dispenser will be described in detailed below. In an inoperative position the opening 311 is open to permit soap in the container 2 to flow through the valve R into an internal space defined by the transverse section 42 and the adjustment ring 70 and store therein since the check valve B is closed. For dispensing soap, a user may depress the cap 9 and thus the plunger 7 as indicated by arrow P in FIG. 5. The plunger 7 thus slides in the abutment member 6 to compress the spring S and push the valve R upward to block the opening 311 as pressure is built up in the decreased space defined by the transverse section 42 and the adjustment ring 70. As such, soap is forced to flow into the bottom section 43 to open the check valve B. As an end, soap flows out of the spout 5 through the check valve B.

In response to removing the depressing force exerted on the cap 9, the stored elastic energy of the spring S pushes the plunger 7 rightward to return same to its original position. At the same time, a vacuum is created in the space defined by the transverse section 42 and the adjustment ring 70 to draw the valve R downward and thus open the opening 311. Soap in the container 2 then flows into the space through the opening 311 and the valve R. Also, the opening B1 of the check valve B is slightly open due to the created vacuum. The remaining soap in the check valve B thus flows out of the spout 5. At the end of returning the plunger 7 to its original position, the check valve B is closed.

Figure 6:
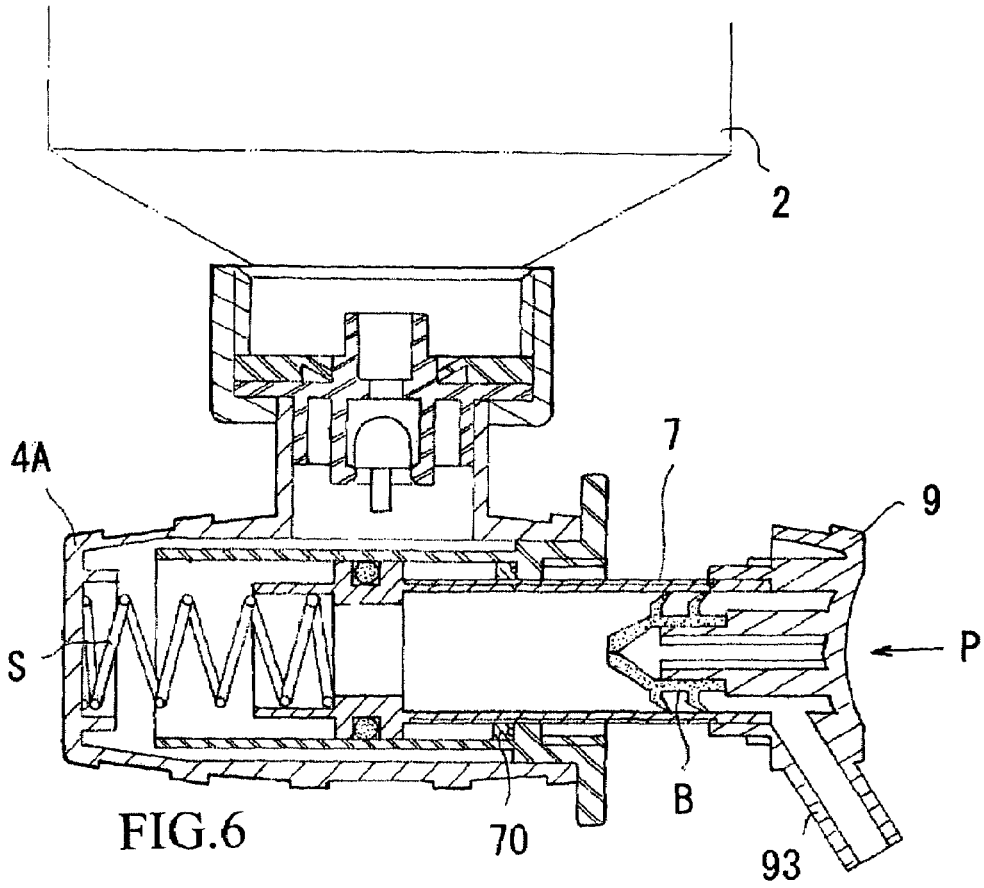
FIG. 6 is a sectional view of a pump mechanism of liquid soap dispenser according to a second preferred embodiment of the invention in its inoperative position.
Figure 7:
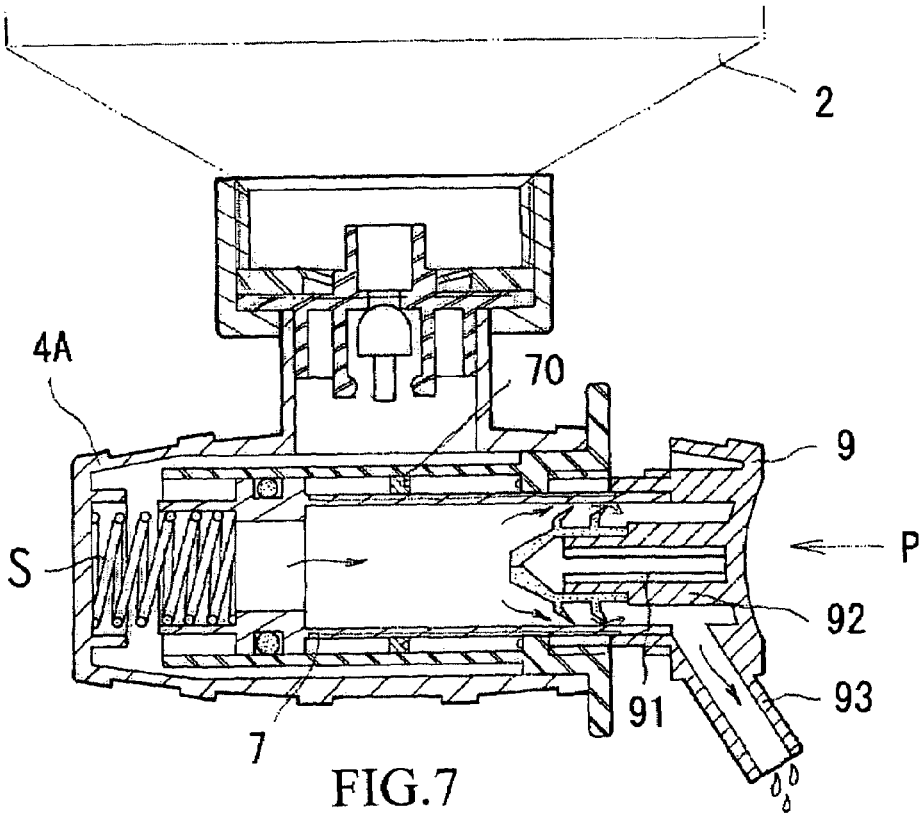
FIG. 7 is a view similar to FIG. 6 where the soap dispenser is in its use position.

Referring to FIGS. 6 and 7, a liquid soap dispenser incorporating a pump mechanism in accordance with a second preferred embodiment of the invention is shown. The second preferred embodiment substantially has same structure as the first preferred embodiment. The differences between the first and the second preferred embodiments, i.e., the characteristics of the second preferred embodiment are detailed below. The cross-shaped pipe 4 is replaced by a T-shaped pipe 4A (i.e., the projecting bottom section 43 is eliminated). A check valve B is provided at an inwardly projecting bar 92 having a bore 91 at an outer end of the plunger 7 and the spout 5 is replaced by a spout 93 also formed at the outer end of the plunger 7. The spout 93 is in fluid communication with the check valve B.

A pumping operation of the liquid soap dispenser according to the second preferred embodiment of the invention will be described in detailed below. In an inoperative position soap stored in the pipe 4A is prohibited from leaving since the check valve B is closed. For dispensing soap, a user may depress the cap 9 and thus the plunger 7 as indicated by arrow P in FIG. 7. The plunger 7 thus slides to compress the spring S and block the soap supply route as pressure is built up in the decreased space defined by the pipe 4A and the adjustment ring 70. As such, soap is forced to flow to the spout 93 through a gap between the check valve B and an inner surface of the plunger 7, i.e., the check valve B is open. As an end, soap flows out of the spout 93.

In response to removing the depressing force exerted on the cap 9, the stored elastic energy of the spring S slides the plunger 7 rightward to return same to its original position. At the same time, a vacuum is created in the space defined by the pipe 4A and the adjustment ring 70 to open the soap supply route. Soap in the container 2 then flows into the space. Also, the check valve B is slightly open due to the created vacuum. The remaining soap in the check valve B thus flows out of the spout 93. At the end of returning the plunger 7 to its original position, the check valve B is closed.

Figure 9:
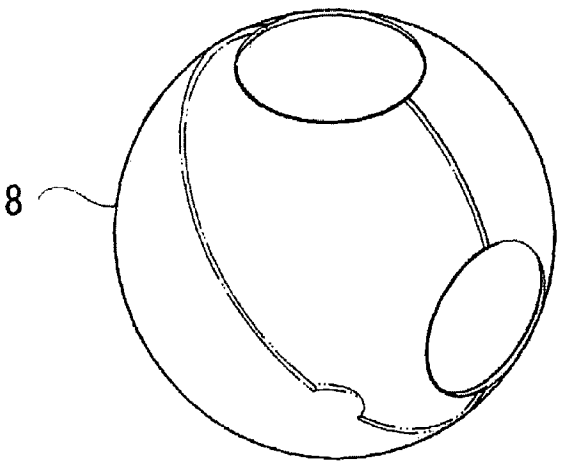
FIG. 9 is a perspective view of the enclosure.
Figure 8:
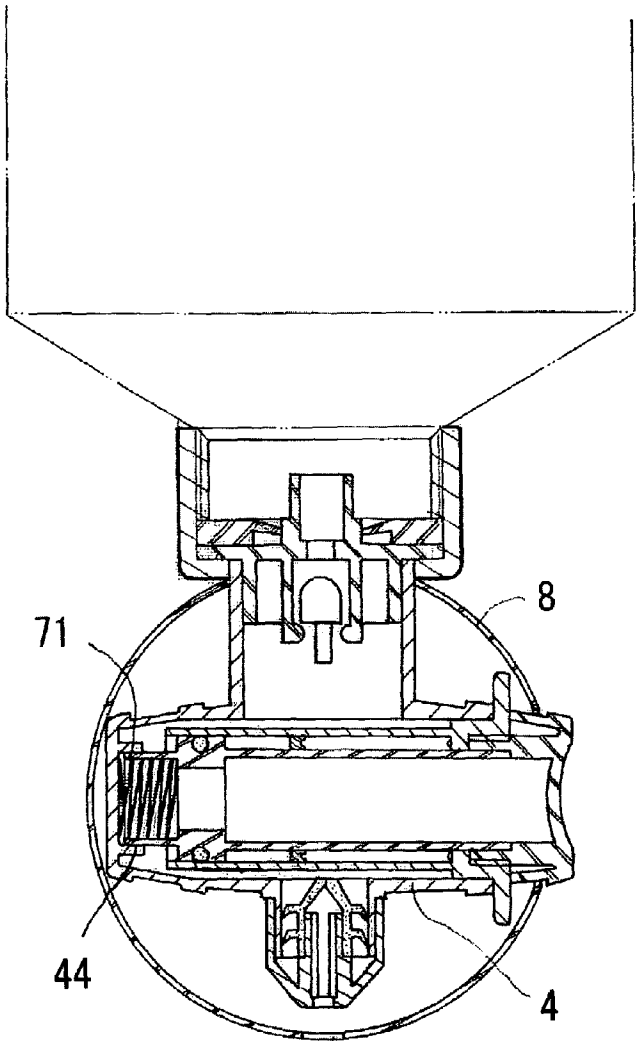
FIG. 8 is a sectional view of a pump mechanism of liquid soap dispenser according to a third preferred embodiment of the invention where the pump mechanism is substantially enclosed by an enclosure.

Referring to FIGS. 8 and 9, a liquid soap dispenser in accordance with a third preferred embodiment of the invention is shown. The characteristic of the third preferred embodiment is that an aesthetic enclosure 8 is fitted around a pump mechanism of the liquid soap dispenser and the pump mechanism is implemented as one described in either embodiment.

Note that the liquid soap dispenser can be implemented as wall mounted one as described above or a stand one with a minimum modification.

While the invention herein disclosed has been described by means of specific embodiments, numerous modifications and variations could be made thereto by those skilled in the art without departing from the scope and spirit of the invention set forth in the claims.

What is claimed is:

1. A device for dispensing liquid soap comprising:

a plastic container filled with supply of liquid soap and including a projecting bottom opening threadedly secured to a nut; and a pump mechanism including:

a first check valve provided in the opening of the container;

a ring member put on the first check valve;

a cross-shaped pipe including a top section secured to the first check valve, a projecting bottom section, and a transverse section;

a spout secured to the bottom section;

a second check valve provided in the spout;

an abutment member provided into and secured to the transverse section;

a sliding plunger partially inserted into the abutment member and including a forward hollow extension, a rear externally threaded portion, a sealing shoulder between the extension and the externally threaded portion, and an adjustment ring threadedly put on the externally threaded portion;

a spring biased between a bottom of the extension and a closed end of the transverse section; and a cap provided on an outer end of the plunger;

wherein in an inoperative position the second check valve is closed and the first check valve is open to permit the supply of liquid soap to flow into a space defined by the transverse section and the adjustment ring and store therein, in response to depressing the cap the plunger slides to compress the spring, close the first check valve, and decrease the space for forcing the supply of liquid soap to flow into the bottom section to open the second check valve prior to flowing out of the spout, and in response to removing a depressing force a stored compression energy of the spring pushes the plunger to its inoperative position to create a vacuum in the space, open the first check valve, permit the supply of liquid soap to flow into the space through the first check valve, and close the second check valve at an end of returning the plunger to the inoperative position;

wherein the ring member is sealingly engaged with the first check valve in the inoperative position; and wherein the ring member is adapted to wrinkle to permit air to enter the container through the opening in response to a decreased pressure within the container after a predetermined amount of the supply of liquid soap has been dispensed.

2. A device for dispensing liquid soap comprising:

a plastic container filled with supply of liquid soap and including a projecting bottom opening threadedly secured to a nut; and a pump mechanism including:

a first check valve provided in the opening of the container;

a ring member put on the first check valve;

a T-shaped pipe including a top section secured to the first check valve and a transverse section;

an abutment member provided into and secured to the transverse section;

a sliding plunger partially inserted into the abutment member and including a forward hollow extension, a rear externally threaded portion, a sealing shoulder between the extension and the externally threaded portion, and an adjustment ring threadedly put on the externally threaded portion;

a second check valve provided in an outer end of the plunger;

a spout secured to the outer end of the plunger and being in fluid communication with the second check valve;

a spring biased between a bottom of the extension and a closed end of the transverse section; and a cap provided on the outer end of the plunger;

wherein in an inoperative position the second check valve is closed and the first check valve is open to permit the supply of liquid soap to flow into a space defined by the transverse section and the adjustment ring and store therein, in response to depressing the cap the plunger slides to compress the spring, close the first check valve, and decrease the space for forcing the supply of liquid soap to open the second check valve prior to flowing out of the spout, and in response to removing a depressing force a stored compression energy of the spring pushes the plunger to its inoperative position to create a vacuum in the space, open the first check valve, permit the supply of liquid soap to flow into the space through the first check valve, and close the second check valve at an end of returning the plunger to the inoperative position;

wherein the ring member is sealingly engaged with the first check valve in the inoperative position; and wherein the ring member is adapted to wrinkle to permit air to enter the container through the opening in response to a decreased pressure within the container after a predetermined amount of the supply of liquid soap has been dispensed.

* * * * *